US005435465A

United States Patent [19]

El-Amin

[11] Patent Number: 5,435,465

[45] Date of Patent: Jul. 25, 1995

[54] HYGIENE DEVICE

[76] Inventor: Hassan A. El-Amin, 10905 Fort Washington Rd. Suite 100, Fort Washington, Md. 20744

[21] Appl. No.: 140,488

[22] Filed: Oct. 25, 1993

Related U.S. Application Data

[63] Continuation-in-part of Ser. No. 24,071, Mar. 1, 1993, abandoned, which is a continuation-in-part of Ser. No. 875,021, Apr. 28, 1992, abandoned.

[51] Int. Cl.[6] ..... B67D 1/16; B67D 5/06; B67D 5/40

[52] U.S. Cl. ..... 222/108; 222/153.14; 222/156; 222/181.2; 222/192; 222/383.3

[58] Field of Search ..... 222/108, 154, 156, 181, 222/183, 185, 325, 383, 505, 509, 192, 153; 141/18, 21, 346, 348, 351, 352, 354, 360

[56] References Cited

U.S. PATENT DOCUMENTS

| | | | |
|---|---|---|---|
| 1,920,867 | 8/1933 | Kirk | 222/383 X |
| 2,008,427 | 7/1935 | Vezina . | |
| 2,319,233 | 5/1943 | Hoppe . | |
| 2,321,844 | 6/1943 | Nicholson | 222/108 X |
| 2,373,171 | 4/1945 | Daly | 222/383 X |
| 2,402,707 | 6/1946 | Stepan, Jr. | 222/156 X |
| 2,547,744 | 4/1951 | Burger . | |
| 2,792,974 | 5/1957 | Smith et al. | 222/383 X |
| 2,841,311 | 7/1958 | Parizek . | |
| 2,942,631 | 6/1960 | Biewald . | |
| 3,178,059 | 4/1965 | Packwood, Jr. | 222/181 X |
| 3,197,081 | 7/1965 | Midworth | 222/181 X |
| 3,865,271 | 2/1975 | Gold . | |
| 3,936,002 | 2/1976 | Geberth, Jr. . | |
| 3,952,918 | 4/1976 | Poitras et al. . | |
| 4,018,363 | 4/1977 | Cassia . | |
| 4,238,056 | 12/1980 | Tucker et al. . | |
| 4,280,643 | 7/1981 | Cordova et al. | 222/181 X |
| 4,360,130 | 11/1982 | Nishimura | 222/181 X |
| 4,530,448 | 7/1985 | Ponyicky | 222/181 |
| 4,662,195 | 5/1987 | Von Buelow et al. . | |
| 4,826,052 | 5/1989 | Micallef . | |
| 4,901,889 | 2/1990 | Mitchell . | |
| 4,998,647 | 3/1991 | Sharp . | |
| 5,183,182 | 2/1993 | Comstock et al. | 222/156 X |

*Primary Examiner*—Kevin P. Shaver
*Attorney, Agent, or Firm*—Richard C. Litman

[57] ABSTRACT

An apparatus for wetting toilet paper prior to the use of the toilet paper. The apparatus may be mounted on a wall or set on a flat surface, and includes a reservoir for storing a fluid. A clamp is provided for holding the reservoir by friction. The reservoir has a screw-on lid and a check valve controlling flow of fluid, enabling the reservoir to be removed without allowing a significant quantity of liquid contents to escape. The check valve is opened by a projecting conduit member when the liquid reservoir is secured by the clamp in its operative position. An internal valve arrangement includes a spring biased piston pressurizing the liquid, and resultant pressure operates a valve enabling dispensing of the liquid. An operating lever acting on the piston is urged by the spring into a "ready" position after each stroke. As the liquid is dispensed onto the toilet paper, any excess liquid is caught by a liquid splash pan located under the user's hand and contained within a removable tray. A hinged cover is provided with a viewing window providing the user with a way to check the level of liquid in the reservoir. In commercial applications, the hygiene device may be provided with a locking cover and a locking liquid splash pan to prevent unauthorized removal of the liquid reservoir and the tray. The lever is disposed to be located below or in front of the discharge path in the "ready" position, and is pushed to a location behind the discharge path during operation. This enables a user to both operate the device and to hold a toilet tissue while using but a single hand.

10 Claims, 3 Drawing Sheets

HYGIENE DEVICE

CROSS-REFERENCE TO RELATED APPLICATIONS

This application is a continuation-in-part application of my prior application Ser. No. 08/024,071, filed Mar. 1, 1993, now abandoned, which is a continuation-in-part of Ser. No. 07/875,021, filed Apr. 28, 1992 now abandoned.

BACKGROUND OF THE INVENTION

1. Field of the Invention

The present invention relates to a hygiene device that is intended to supply a certain amount of a liquid such as water to wet a tissue before using the same.

2. Description of the Prior Art

In the prior art hygiene devices, there are various ways used to wet toilet paper before the toilet paper is used. One way of wetting the toilet paper involves pulling some of the toilet paper from a toilet paper roll and holding it under the nozzle of a liquid dispenser, then pressing a button to activate the dispenser to deposit some water on the toilet paper. The paper itself may be specially made by laminating the toilet paper to a moisture resistant backing layer such as a water soluble, wax backed sheet. Another way of wetting the toilet paper involves rotatably mounting a roll of toilet paper in a holder which includes a body containing a fluent substance under pressure and a discharge nozzle at one end of the holder. Both of these apparatuses are complicated and messy to use.

U.S. Pat. No. 4,998,647 issued Mar. 12, 1991 to Peggy Sharp discloses a detachable multi-unit dispenser and hanging support which has detachable containers with cone shaped filling units in the dispenser. Each filling unit has a normally closed, button operable valve which controls an outlet in each container. Detachably secured to the bottom of the dispenser by suction cups is a removable platform. However, the nozzle in this case is operated by pressing in an upwards manner on a button located behind the nozzle.

U.S. Pat. No. 4,901,899 issued Feb. 20, 1990 to Joseph Mitchell discloses a mounting apparatus for mounting a roll of toilet paper in a wall fixture, and which incorporates structure for dispensing a fluent substance.

U.S. Pat. No. 4,826,052 issued May 2, 1989 to Lewis A Micallef discloses a dispensing pump with a nozzle/-lever combination where the lever is pulled in a backwards manner to cause the nozzle to discharge a liquid in a forwards direction.

U.S. Pat. No. 4,662,195 issued May 5, 1987 to John von Buelow et al. discloses a wall mounted soap dispenser made of plastic which has a hand operated pump. The pump and container are enclosed in a plastic housing which is hingedly mounted on a plastic wall plate. A plastic latch with a plastic key is used to lock the housing to the wall mounting plate. The pump mechanism uses a piston of two sections of different diameter and corresponding piston chamber of two sections of different diameter. The piston is attached to the lever which moves the piston by means of a crossbar on the end of the piston rod.

U.S. Pat. No. 4,238,056 issued Dec. 9, 1980 to Council A. Tucker et al. discloses a soap dispenser mounted in a cabinet. The dispenser has a sump, a container and an actuating lever. The reservoir container is supported in an inverted attitude on the reservoir sump, emptying downwardly thereinto, and partially forwardly overlies the actuating lever, being forwardly supported to prevent the container from inadvertently depressing the actuating lever dispensing soap from the dispensing mechanism when the container is removed forwardly and replaced rearwardly to replenish the soap supply.

U.S. Pat. No. 4,018,363 issued Apr. 19, 1977 to Antonio Macchi Cassia discloses a soap dispenser with a support bracket adapted to be mounted on a wall, actuating structure attached to the support bracket, and a pump for emitting a charge of liquid soap from the nozzle, the actuator allowing the soap to flow from the nozzle by pulling a control plate from a normal position.

U.S. Pat. No. 3,936,002 issued Feb. 3, 1976 to John D. Geberth, Jr. discloses an adjustable spray tip or nozzle for devices which are adapted to hydraulically atomize and spray liquids.

U.S. Pat. No. 3,865,271 issued Feb. 11, 1975 to Max Gold discloses a personal cleaning device that has a feature of dispensing liquids onto a specially made toilet paper which has a moisture resistant backing material.

U.S. Pat. No. 2,942,631 issued Jun. 28, 1960 to Harold F. Biewald discloses a pressurized container and auxiliary adaptor/actuators therefor. The adaptor/actuator is designed to deposit the contents of the pressurized container onto the hand or tool which is used to actuate the adaptor/actuator.

U.S. Pat. No. 2,841,311 issued Jul. 1, 1958 to Ferdinand Parizek discloses a soap dispenser in the form of a bottle which can be fixed by a clamp to the wall in a vertical position with the opening facing downwardly, and can be removed after loosening the clamp, and is provided with a dispensing device for dispensing successive batches of liquid soap. The dispensing device includes a pin which is urged outwardly by a spring. When the pin is pushed upward, a batch of soap is dispensed.

U.S. Pat. No. 2,547,744 issued Apr. 3, 1951 to Irving A. Burger discloses a measuring device for liquid containers. The container is held in an inverted position by means of a spring clip which is, in turn, held against a portion of a wall or the like by means of screws. Slidable in a neck portion of the container is a valve comprising a stem portion and a radially extending disk-like head portion. A T-shaped passageway is provided through the valve and includes a cross portion and a longitudinal portion. The cross portion opens through opposite sides of the stem while the longitudinal passage opens through the lower side of the head. The stem portion has a sliding fit in the neck of the container. When the valve is in its lowermost position, the ends of the passage portion are closed by engagement with the interior of the container neck so that the contents of the container may not enter into the valve. This is the normal position of the valve which is urged into such a position and resiliently held in such a position by a small coil spring. This spring is anchored in place by the partial reception of one of the coils in a groove in the container neck and the partial reception of a second coil in a hole or groove in the stem portion of the valve. When some of the contents of the container are desired, the cap of the container is unthreaded from its position on the container. Then, by moving the container somewhat laterally, a portion of an annular shoulder of the cap is engaged with the underside of an edge portion of the annular head or flange. Now, on the cap being shifted upwardly, the valve is moved inwardly with respect to the bottle neck exposing the ends of the cross passage to the interior of the container. At this time, the contents of the container may flow into the T-shaped passage, entering through either or both ends of the cross passage, and is discharged through the lower end of the longitudinal passage into the cap. When the height of the liquid in the cap reaches the under or lower side of the head or flange, the entrance of air into the container is prevented and a liquid seal is established.

U.S. Pat. No. 2,319,233 issued May 18, 1943 to Charles W. Hoppe discloses a soap dispenser in the form of a unit which can be mounted on a wall or other suitable supporting structure and which is operated by the manual reciprocation of a plunger or push rod thereby to discharge a measured amount of soap.

U.S. Pat. No. 2,008,427 issued Jul. 16, 1935 to Joseph R. Vezina discloses an extractor device for shaving cream and the like which delivers a measured amount of shaving cream from a suitable receptacle and delivers it onto a shaving brush. Located within the device are two valves which operate in opposite directions, one of which permits the substance to be ejected when a downward movement is imparted to the device and the other, or inlet valve, is then closed and when an upward movement is imparted to the device, the discharge valve is closed and the inlet valve is opened.

In the conventional personal cleaning devices discussed in the above patents, none of the apparatuses provide for a lever which, when a hand pushes against it, activates a nozzle to allow a metered amount of a liquid, such as water, out of a reservoir to wet the toilet paper held on the hand. Also there is no provision for a check valve such as the check valve used in the instant invention which utilizes a ball or check valve and pin assembly.

None of the above inventions and patents, taken either singly or in combination, is seen to describe the instant invention as claimed.

SUMMARY OF THE INVENTION

The present invention enables quick, convenient dispensing of a liquid, as for moistening a tissue. It is an important attribute of the invention that it be operated by a single hand of a user. These capabilities are intended to overcome the problems of the prior art personal cleaning devices by providing an apparatus with a liquid reservoir in a cylindrical shape which has a screw on cap with a lever and a nozzle (such as the nozzle/-lever combination disclosed in U.S. Pat. No. 4,662,195 issued May 5, 1987 to John von Buelow et al.), a liquid splash pan and, optionally, a holder for toilet paper attached below the liquid splash pan.

Accordingly, it is a principal object of the invention to provide an apparatus for dispensing liquid downwardly, responsive to a user pushing a lever out of the way, a dispensing nozzle being disposed so as to discharge liquid onto the user's hand.

It is another object of the invention to provide an apparatus for wetting a tissue which is easy to use; that is, capable of being operated with one hand—the same hand which may be employed to hold the tissue.

It is a further object of the invention to provide an apparatus for wetting tissue or toilet paper which is able to dispense a liquid, such as water, in either a spray or a stream, as determined by the user.

Still another object of the invention is to provide an apparatus for wetting toilet paper which is able to dispense a predetermined quantity of a liquid, such as water.

It is yet a further object of the invention to provide an apparatus for wetting toilet paper which is completely self-contained and requires no plumbing or any other fixtures or attachments of any kind for installation or use.

It is again an object of the invention to provide for visual observation of liquid stored therein.

It is yet another object of the invention to provide a tray for catching and retaining liquid which might otherwise fall onto environmental surfaces if not retained in the hand of or in tissue held by a user.

Still an additional object of the invention is to provide a strainer to exclude objects from the catch tray of the hygiene device.

Still another object of the invention is to provide a cover for a hygiene device which pivots away therefrom, enabling access to the interior thereof.

A further object of the invention is to provide ready access to the storage reservoir of the novel hygiene device.

It is an additional object of the invention to provide an apparatus for wetting toilet paper which does not necessitate the use of specially made toilet paper.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
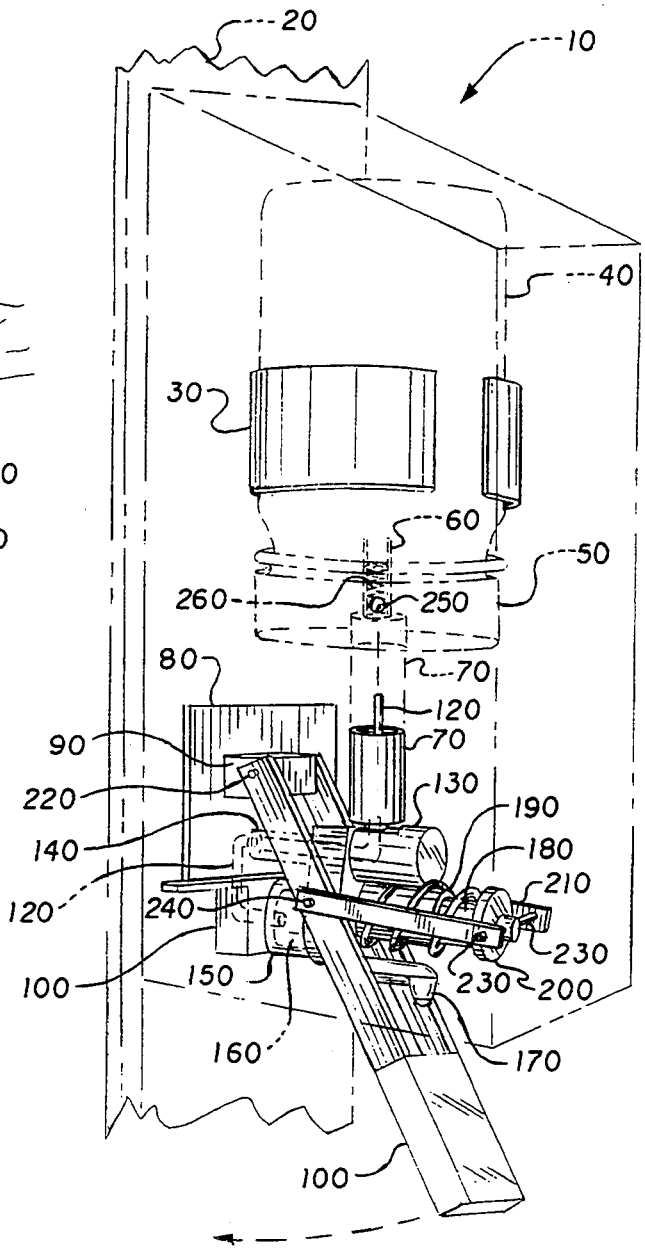
FIG. 2 is a partial perspective view of the hygiene device of FIG. 1 showing the wall clamp and the nozzle/valve/lever combination in greater detail, with the wall receptacle and the container drawn in phantom lines.

The present invention is a hygiene device for dispensing a fluid. With particular reference to FIG. 2, the hygiene device 10 has a plate or wall receptacle 20 with a clamp 30 for receiving a filled liquid reservoir 40 made out of a clear material, such as glass or plastic, that is either refillable or disposable. Wall receptacle 20 both provides structure for attachment to a vertical environmental surface, and also protects the same from incidental splashing. The liquid reservoir 40 has a screw on lid 50 with a standard check or ball valve 60 located at and through a center point of lid 50. Attached to wall receptacle 20 is a plate 80 which has a block 90 attached thereto. Block 90, in turn, has a lever 100 attached by pins 220 at an angle. Below plate 80, a second plate 110 is attached to wall receptacle 20. A small standpipe 120 is threaded through a series of pipes 70, 130, 140 and 150. Pipe 150 has a smaller pipe 160 into which standpipe 120 empties and to which nozzle 170 is also attached. Standpipe 120 is therefore seen to maintain check valve 60 open when reservoir 40 is in operative position, and also conducts liquid flowing from reservoir 40.

A push rod 180 terminating in an integral piston (see FIG. 5) is contained within pipe 160 with a spring 190 contacting push rod 180 at end 200 thereof, spring 190 being constrained against expension by a portion of pipe 160.

Operation of hygiene device 10 is performed by pushing on lever 100. In order to transmit operating motion from lever 100 to components utilizing this motion, two rods 210 are attached between lever 100 and push rod 180, and are secured there by two pins 230 and 240. Indirect action of lever 100 on subsequent components is important, since this arrangement enables lever 100 to be situated advantageously, being readily manipulated by one hand, while enabling that one hand to remain disposed beneath discharge of liquid by nozzle 170. In this arrangement, and as shown clearly in FIG. 1, lever 100 is moved to a substantially vertical orientation towards the back of hygiene device 10. As employed herein, the back of hygiene device 10 is that part thereof which is mounted to a vertical environmental surface, and the front is that portion visible to a user when so mounted.

It must be emphasized that relative positions of lever 100 and nozzle 170 are important to the objects of the invention. Moving of lever 100 from a location directly beneath or ahead of nozzle 170 to a location behind lever 100 assures that a user can both operate the hygiene device, and also hold a tissue for capturing discharge of liquid from nozzle 170, accomplishing these two functions with but a single hand.

There is linear, communicating continuity among pipes 70, 120, 130, 140, 150, and 160, although these reference numerals do not reflect the sequential locations within the fluid circuit of the respective pipes. These pipes conduct fluid from reservoir 40 through a valving arrangement 400 which will be discussed in greater detail hereinafter, finally discharging the fluid through nozzle 170.

Overall operation of hygiene device 10 will now be discussed in further detail. Liquid reservoir 40 is filled with a liquid such as water and lid 50 is screwed onto reservoir 40. Then, reservoir 40 is inverted and placed into clamp 30. As long as reservoir 40 is kept in such a position as to keep check valve 60 above standpipe 120, the ball 250 is urged downwardly by spring 260 such that the liquid is kept within reservoir 40. After reservoir 40 has been pushed downwards into place in clamp 30, standpipe 120 urges ball 250 upwards which allows liquid to leave reservoir 40 and fill standpipe 120. Push rod 180 is normally urged outward by spring 190 such that nozzle 170 is not filled by the liquid contained in standpipe 120. When lever 100 is pushed back, rods 210 urge push rod 180 back which causes standpipe 120 to be emptied through nozzle 170. As push rod 180 is allowed to be urged forward by spring 190, nozzle 170 is again cut off from communication with standpipe 120.

Figure 1:
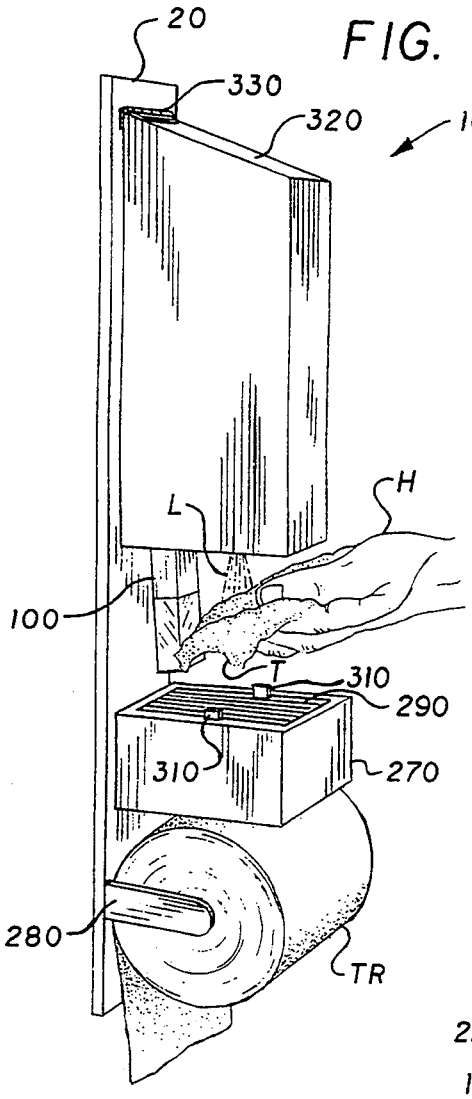
FIG. 1 is an environmental perspective view of a first embodiment of the hygiene device of the present invention with a roll of toilet paper mounted on the wall apparatus below the tray which catches excess liquid.

Rods 210 enable lever 100 to be remotely connected to, and operably control, valving arrangement 400. As employed herein, "remotely connected to" is understood to signify that lever 100 does not itself directly contact a component of valving arrangement 400. Rather, there is at least one additional member transmitting motion between these components. As shown in FIG. 1, this arrangement enables lever 100 to be pushed out of underlying relationship to nozzle 170 during use of hygiene device 10, while still being operably connected to valving arrangement 400.

Figure 3:
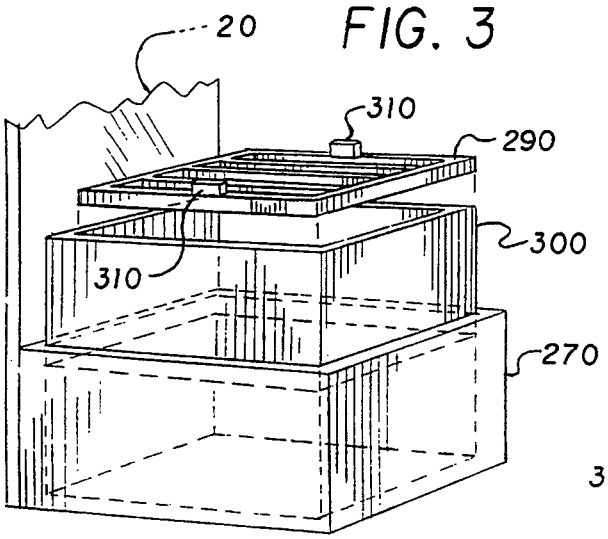
FIG. 3 is an exploded view of the removable tray and grille of the first embodiment.

Referring to FIG. 1 in greater detail, a first embodiment, useful for household or domestic use, is illustrated. Wall receptacle 20 is mounted on a wall or other supporting structure. A liquid splash pan or tray 270 is attached below lever 100 with a mounting bracket 280 for a roll of toilet paper TR attached below liquid splash pan 270. Splash pan 270 collects liquid for catching liquid which might otherwise fall onto an environmental surface. As a hand H holding a small amount of toilet paper T is pushed against lever 100, a metered amount of liquid L is sprayed onto toilet paper T with any excess liquid filtering through a removable grille 290 into a removable tray 300 (see FIG. 3) contained in liquid splash pan 270. Grille 290 traps cigarettes or other objects which might otherwise fall into liquid trapped in tray 300.

Figure 4:
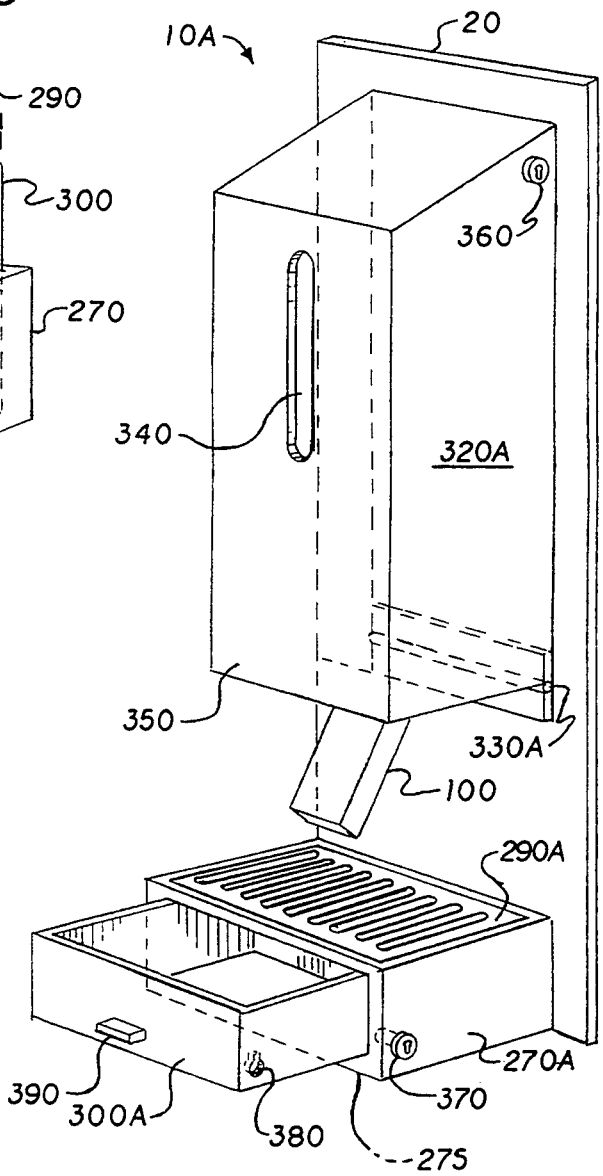
FIG. 4 is a perspective view of the second embodiment of the present invention showing the locks on the cover and the removable drawer with the removable drawer partially pulled out.

After removable tray 300 is full, handles 310 on removable grille 290 are used to remove grille 290, at which time, removable tray 300 is able to be removed and emptied. Then, grille 290 and tray 300 are replaced in liquid splash pan 270. In this embodiment, a clear cover 320 is hinged to wall receptacle 20 by hinges 330 which are attached to a top, back juncture of cover 320 and wall receptacle 20 thereby allowing cover 320 to be swung up and out of the way when it is desired to access reservoir 40 for refilling and/or cleansing. This embodiment may optionally omit the mounting bracket 280, as shown in FIG. 4, the wall receptacle 20 being shortened to end at the bottom of liquid splash pan 270. In this manner, hygiene device 10 is provided with a horizontal, planar bottom surface 275, and may be placed onto a counter top, rather than attached to a wall (not shown), thereby saving one from having to drill holes in the wall in order to mount hygiene device 10.

Again referring to FIG. 4, a second or commercial embodiment of hygiene device **10*a* is illustrated. In this embodiment, a clear slot 340 is provided in a front surface 350 of nontransparent cover 320*a* to allow one to visually check the contents of reservoir 40 for quantity and clarity. The cover 320*a* of this embodiment additionally has hinges 330*a* located along the bottom, back juncture between cover 320*a* and wall receptacle 20 such that cover 320*a* can be swung downwardly, or forwardly, away from wall socket 20, when one desired to refill or replace reservoir 40. There is a lock 360 located near the top of cover 320*a* such that cover 320*a* may be locked to prevent theft of reservoir 40. In addition, instead of a removable grille 290 and a removable tray 300, grille 290*a* is nonremovable and tray 300*a* is in the form of a removable drawer 300***a* installed in a liquid splash pan 270*a* which is in the form of a drawer receptacle 270*a*. Drawer 300*a* has a handle 390 located on a front surface of drawer 300*a* to facilitate the removal of drawer 300*a*. A locking mechanism 380 on drawer 300*a* mates with a locking mechanism 370 located through a side wall of drawer receptacle 270*a* to prevent theft of removable drawer 300*a*.

Figure 6:
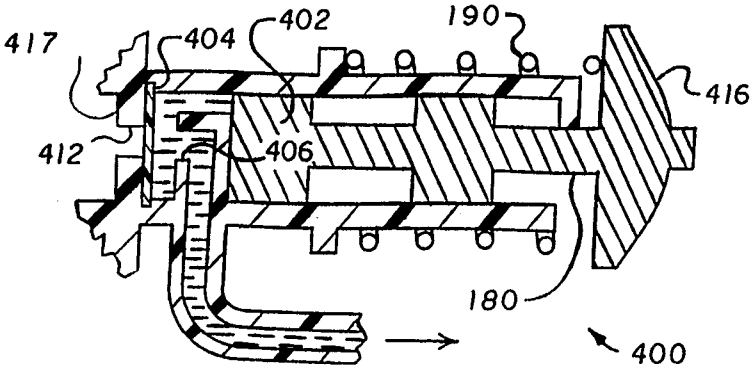
FIGS. 5 and 6 are diagrammatic, cross sectional detail views of a valve arrangement concealed within a component shown in the lower portion of FIG. 2, showing, respectively, the valve in its normal condition, and as actuated by operation of the novel hygiene device.
Figure 5:
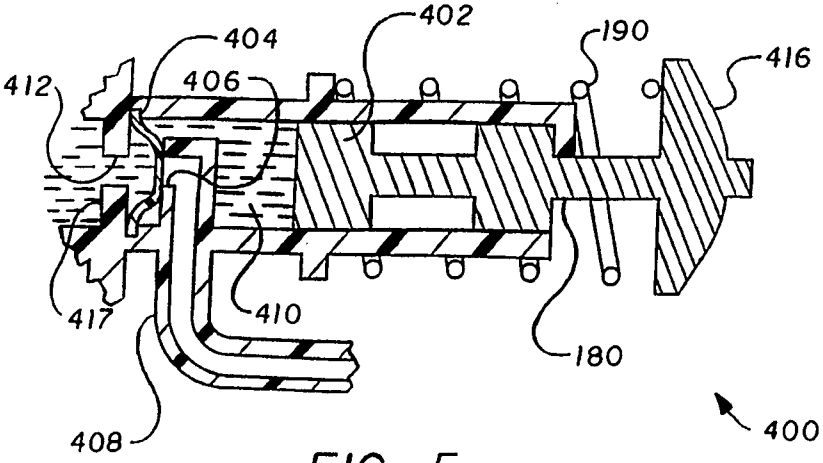

Valving arrangement 400 is shown in FIGS. 5 and 6. Turning first to FIG. 5, valving arrangement 400 is shown in its normal condition. Push rod 180 is held in the normal, closed condition by spring 190. As push rod 180 is urged into the normal condition following use of hygiene device 10, suction exerted by piston 402 draws a flexible diaphragm 404 into the orientation shown in FIG. 5. In this orientation, diaphragm 404 seals orifice 406 formed in a discharge conduit 408 leading to nozzle 170 (see FIG. 2). Suction also causes fluid to be drawn from reservoir 40 (see FIG. 2) through an orifice 412 into fill chamber 410.

Figure 7:
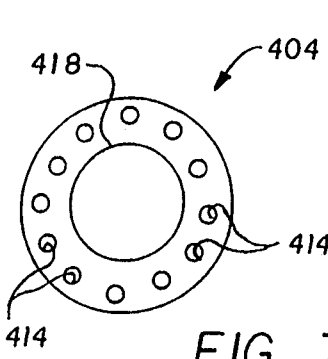
FIG. 7 is a front elevational detail view of a component of the valve arrangement of FIGS. 5 and 6.

This is enabled by perforations 414 (see FIG. 7) formed in diaphragm 404. Fluid flows through orifice 412, then through perforations 414 into fill chamber 410. Perforations 414 (see FIG. 7) are unobstructed by discharge conduit 408 because of their location near the periphery of diaphragm 404.

Valving arrangement 400 is operated by a person initiating fluid dispensing by pushing on lever 100 (see FIG. 2), which actuates push rod 180. As seen in FIG. 6, push rod 180 is moved to the left, when lever 100 depresses button 416. This causes piston 402 to displace fluid formerly held in fill chamber 410 (see FIG. 5). Diaphragm 404 flexes, now exposing orifice 406, and also blocking orifice 412. Perforations 414 are obstructed by a wall 417, which also defines orifice 412. As diaphragm 404 seats against wall 417, contact is established along a line 418 (see FIG. 7) such that orifice 412 is covered by that portion of diaphragm 404 inside line 418. Fluid is thereby essentially constrained to exit valve arrangement 400 through orifice 406 and into discharge conduit 408, as indicated by arrow. Discharge conduit 408 leads to nozzle 170 (see FIG. 2). Fluid is ejected as either a stream or as a spray, depending upon pressure exerted by piston 402, and the configuration of nozzle 170.

Figure 8:
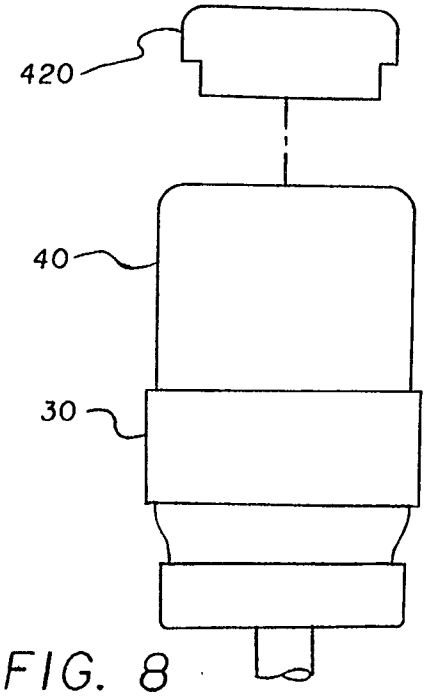
FIG. 8 is a fragmentary, front elevational detail view of the reservoir of the novel hygiene device, showing a removable cap.

In an alternative embodiment to both household and commercial versions of the invention, and as illustrated in FIG. 8, reservoir 40 includes a removable cap, which enables convenient replenishing of fluid without substantially disassembly of hygiene device 10.

It is to be understood that the present invention is not limited to the embodiments described above, but encompasses any and all embodiments within the scope of the following claims.

I claim:

1. A personal hygiene device for wetting a wiping medium, comprising:

a receptacle having a holder dimensioned and configured to hold a liquid reservoir with a press fit;

said liquid reservoir having a closed end and an open end;

a lid removably attachable to said open end;

a normally closed check valve mounted through said lid;

a lever attached to said receptacle;

connection means;

a push rod attached by said connection means to said lever;

said push rod being normally urged outwardly by a spring and being connected to a piston, said piston being capable of reciprocating within a fill chamber and positioned therein;

a nozzle in fluid communication with said fill chamber;

a standpipe attached to said receptacle, said standpipe being curved and having an upper end and a lower end, said lower end being normally closed by a dispensing valve means, said dispensing valve means being movable between a first position closing said lower end and a second position obstructing fluid communication between said fill chamber and said nozzle; and said upper end being placed to urge said check valve open when said liquid reservoir is placed in said holder, whereby when said push rod is urged outwardly by said spring, said dispensing valve means is moved to said second position due to suction exerted by movement of said piston within said fill chamber, thereby allowing said fill chamber to fill with an amount of fluid from said reservoir, and when said lever is pushed back by a hand of a user, said piston is pushed back into said fill chamber displacing the amount of fluid filling said fill chamber, thereby moving said dispensing valve means to said first position and allowing a metered amount of fluid, said metered amount corresponding to the amount of fluid filling said fill chamber, to flow out of said nozzle.

2. The hygiene device according to claim 1, said holder being a clamp.

3. The hygiene device according to claim 2, said lid being screw threaded onto said open end.

4. The hygiene device according to claim 1, said connection means comprising:

two rods being attached to said lever by a first pin at one end of said two rods;

said two rods being attached to said push rod by a second pin at another end of said two rods; and said second pin being passed through a forward end of said push rod.

5. The hygiene device according to claim 1, further comprising:

a liquid splash pan attached to said receptacle a spaced distance below said nozzle;

a splash area being located between an area behind said nozzle and said liquid splash pan;

said splash area being an integral part of said receptacle;

a tray being removably placed in said liquid splash pan for removing and emptying excess liquid in said tray;

a grille located over said tray to prevent viewing of the excess liquid; and a smooth cover hingedly attached to said receptacle to cover said liquid reservoir.

6. The hygiene device according to claim 1, further including:

a mounting bracket for holding a roll of toilet paper; and said mounting bracket being mounted on an extension of said receptacle located below said liquid splash pan.

7. The hygiene device according to claim 5, wherein said removable tray is in the form of a drawer;

said grille forms an integral portion of said liquid splash pan;

said grille is located in a top portion of said liquid splash pan;

a first locking mechanism is provided on a side of said liquid splash pan;

a second locking mechanism is provided on a side of said drawer; and said first locking mechanism has a mating relationship with said second locking mechanism, whereby said first locking mechanism and said second locking mechanism prevent said drawer from being stolen.

8. The hygiene device according to claim 7, further including a third locking mechanism disposed through said cover, whereby said third locking mechanism prevents said liquid reservoir from being removed.

9. The hygiene device according to claim 8, wherein at least part of said smooth cover is made of a transparent material, whereby a user is able to determine a quantity and a clarity of a liquid in said liquid reservoir by visual observation.

10. The hygiene device according to claim 5, further having a horizontal, planar bottom surface, whereby said hygiene device may be supported on a horizontal environmental surface.

* * * * *